US007178913B2

(12) United States Patent
Kumamoto et al.

(10) Patent No.: US 7,178,913 B2
(45) Date of Patent: Feb. 20, 2007

(54) INK JET RECORDING APPARATUS

(75) Inventors: Kouichi Kumamoto, Hachioji (JP); Yoshihide Hoshino, Hachioji (JP); Takeshi Yokoyama, Hachioji (JP)

(73) Assignee: Konica Minolta Medical & Graphic, Inc. (JP)

( * ) Notice: Subject to any disclaimer, the term of this patent is extended or adjusted under 35 U.S.C. 154(b) by 294 days.

(21) Appl. No.: 10/842,134

(22) Filed: May 10, 2004

(65) Prior Publication Data

US 2004/0227801 A1 Nov. 18, 2004

(30) Foreign Application Priority Data

May 15, 2003 (JP) ..... 2003-137846

(51) Int. Cl.
*B41J 2/01* (2006.01)

(52) U.S. Cl. ..... 347/102; 347/14; 347/17

(58) Field of Classification Search ..... 347/102, 347/14, 17

See application file for complete search history.

(56) References Cited

U.S. PATENT DOCUMENTS

| | | | | |
|---|---|---|---|---|
| 6,407,767 | B1 * | 6/2002 | Klees et al. | 347/241 |
| 2002/0060727 | A1 * | 5/2002 | Nishita | 347/100 |
| 2005/0018026 | A1 * | 1/2005 | Nerad et al. | 347/102 |

* cited by examiner

*Primary Examiner*—Stephen Meier
*Assistant Examiner*—Ly T. Tran
(74) *Attorney, Agent, or Firm*—Cantor Colburn LLP

(57) ABSTRACT

An ink jet recording apparatus comprises: an ink jet type of a recording head in which ink jet openings for jetting a photo curing ink are arranged so as to face a recording medium; a light source which is set so as to be opposite to a face of the recording medium to which ink is jetted, and which irradiates a light for curing the ink after the ink is jetted; a light intensity measuring section for measuring a light intensity of the light irradiated from the light source; a temperature measuring section for measuring an ambient temperature of the light intensity measuring section; and a light source control section for correcting a measured light intensity of the light source in accordance with measurement results from the light intensity measuring section and the temperature measuring section.

7 Claims, 5 Drawing Sheets

INK JET RECORDING APPARATUS

BACKGROUND OF THE INVENTION

1. Field of the Invention

The present invention relates to an ink jet recording apparatus, particularly to an ink jet recording apparatus using a photo curing ink.

2. Description of Related Art

A lot of ink jet recording apparatuses are used at present because each of them only generates comparatively small noises under printing and has a high print quality.

An ink jet recording apparatus forms an image on a recording medium such as paper by moving relative positions of a recording head and the recording medium while using a piezoelectric device, heater device or the like, jetting ink from a nozzle of the recording head as minute droplets toward the recording medium, and infiltrating or fixing the ink into or in the recording medium.

An ink jet recording apparatus includes for example, the serial head type for forming an image by reciprocating a recording head on a recording medium and feeding the recording medium in a direction orthogonal to the scanning direction of the recording head, and the line head type for forming an image by using a recording head fixed with a nozzle string covering the recording width of the recording medium and feeding the recording medium in a direction vertical to the direction of the recording width of the recording medium.

At present, in the field of such as printing for commercial products and commercial-product packaging materials, needs for small-lot production are increased and the frequency of using an ink jet system capable of producing a mall lot at a low cost is increased compared to a system requiring plate making such as a gravure printing system or flexographic printing system.

As well known, materials having no absorbability such as resin and metal are frequently used for commercial products and commercial-product packaging materials.

To use one of these materials having no absorbability as a recording medium, a photo curing type of ink jet recording apparatus is developed which cures and fixes a high viscosity, photo curing ink by jetting the ink onto a recording medium and attaching the ink to the recording medium and then irradiating the medium with light such as ultraviolet rays in order to make it possible to fix the ink to the recording medium.

In the earlier development, such photo curing type of ink jet recording apparatus includes an ultraviolet curing type of ink jet recording apparatus which is hitherto practically used and which is constituted so as to irradiate much ultraviolet rays in the block by using a radical polymerization ink. Moreover, it is proposed to use a light source for irradiating the light having a directivity such as a laser beam (for example, refers to JP-Tokukai 2001-310454). Specifically, a semiconductor laser and a light emitting diode are known as light sources for irradiating the light having a directivity.

The use of a semiconductor laser or light emitting diode reduces the calorific value for irradiation and power consumption. Moreover, a light source unit is downsized compared to the case of a fluorescent lamp or a high pressure mercury lamp. Further, the semiconductor laser and light emitting diode are stable and easy in adjustment of light intensity.

However, the above earlier development has the following problem.

When a radical polymerization ink is used, it is necessary to irradiate a comparatively large amount of ultraviolet rays. Therefore, it is a problem that a high-output light source apparatus must be mounted, leading to the increase of its size and fabrication cost.

To solve the above problems, it is considered to use a cationic polymerization ink which is not practically used at present. However, because the cationic polymerization ink has an unstable physical property such as temperature dependence and a physical property of causing a curing reaction due to weak light such as reflected light, it is difficult to handle the ink and thereby, this makes practical use of it difficult.

For example, when the illumination to ink is lowered due to deterioration resulted from the long-term use of a light source or as the light source is made closer to a recording head because of a request for downsizing a recording apparatus, the illumination is lowered due to ink mist. Under the above situation, when the cationic polymerization ink having the above physical property is used, a curing trouble easily occurs and thereby, the ink cannot be practically used.

It is considered to measure the influence of a light source due to the ink mist as a change of light intensities and reflect the measurement result on the lighting operation of the light source. Particularly in the case of light intensity measurement, normal measuring instruments respectively have a specific temperature characteristic and a slight fluctuation occurs in measurement results due to an ambient temperature. Thereby, such fluctuation becomes a measurement error. Therefore, there was a problem that it was difficult to accurately measure the influence of a light source due to ink mist.

SUMMARY OF THE INVENTION

The present invention was made in view of the above earlier developments and its objects are to provide an ink jet recording apparatus using a photo curing ink and moreover improve the reliability of the apparatus by preventing a printing trouble due to a curing trouble, to thereby practically use an ink having a high curing sensitivity to be cured by a comparatively low-output light source.

To solve the above problems, an ink jet recording apparatus of the present invention comprises:

an ink jet type of a recording head in which ink jet openings for jetting a photo curing ink are arranged so as to face a recording medium;

a light source which is set so as to be opposite to a face of the recording medium to which the ink is jetted and which irradiates a light for curing the ink after the ink is jetted;

a light intensity measuring section for measuring a light intensity of the light irradiated from the light source;

a temperature measuring section for measuring an ambient temperature of the light intensity measuring section; and a light source control section for correcting a measured light intensity of the light source in accordance with measurement results from the light intensity measuring section and the temperature measuring section.

By use of such ink jet recording apparatus, ink is jetted from the recording head to the recording medium, light is applied toward the ink from the light source, the ink is cured by the light, and recording is performed.

In the case of the above recording, the light intensity of the light irradiated from the light source is measured by the light intensity measuring section and the ambient temperature of the light intensity measuring section is measured by the temperature measuring section. For example, the light source control section first determines whether the light source irradiates light at a light intensity with a certain level or higher. When the light intensity becomes lower than the certain level, the light source control section increases the light intensity by increasing the output of the light source.

In the case of light intensity measurement however, each measuring instrument normally has a specific temperature characteristic and a slight fluctuation occurs in measurement results due to the ambient temperature. Therefore, the fluctuation becomes a measurement error.

Therefore, the light source control section can accurately control the light source correspondingly to the ambient environment by further considering the ambient temperature as a measurement result related to the temperature and controlling the light intensity of the light source.

Therefore, the reliability of the apparatus is improved by preventing a printing trouble due to a curing trouble, thereby to practically use an ink having a high curing sensitivity to be cured by a comparatively low-output light source, leading to the increase of its size and fabrication cost.

A temperature-light intensity conversion table consulted to correct the light intensity in accordance with a temperature measurement result from the temperature measuring section may be provided, the light source control section may control the light intensity of the light source in accordance with an intensity to be corrected, and the intensity may be obtained by consulting the temperature-light intensity conversion table.

By use of such ink jet recording apparatus, the specific temperature characteristics of a light source measuring section are previously formed into a conversion table and a measurement result from the light source measuring section is corrected in accordance with the temperature characteristics to thereby obtain a corrected light intensity in accordance with a measurement result from the light source measuring section and control the light source in accordance with the obtained light intensity without complex control such as the control of the sensitivity of the light source measuring section. Therefore, the control operation by a light source control section is simplified.

A driving section for scanning the light source up to a measuring position opposite to the light intensity measuring section may be provided.

By use of such ink jet recording apparatus, it is possible to preferably apply the present invention to an ink jet recording apparatus using a serial type of recording head.

A transfer section for scanning the light intensity measuring section up to the measuring position opposite to the light source may be provided.

By use of such ink jet recording apparatus, it is possible to preferably apply the present invention to an ink jet recording apparatus using a line type of recording head.

Further, light source apparatuses having the light source may be provided, and the light intensity measuring section may measure the light intensity of each light source apparatus.

By use of such ink jet recording apparatus, the light intensities of each light source apparatus can be accurately controlled.

It is preferable that the ink jetted from the recording head is an ultraviolet curing ink.

By use of such ink jet recording apparatus, it is possible to preferably apply the present invention to an ink jet type of recording apparatus using the ultraviolet curing ink.

It is desirable that the ink is a cationic polymerization ink.

By use of such ink jet recording apparatus, it is possible to easily fix the cationic polymerization ink to a recording medium because the ink has a high sensitivity to ultraviolet rays compared to a radical curing ink.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

Embodiments of an ink jet recording apparatus of the present invention are described below in detail by referring to FIGS. 1 to 7.

Figure 1:
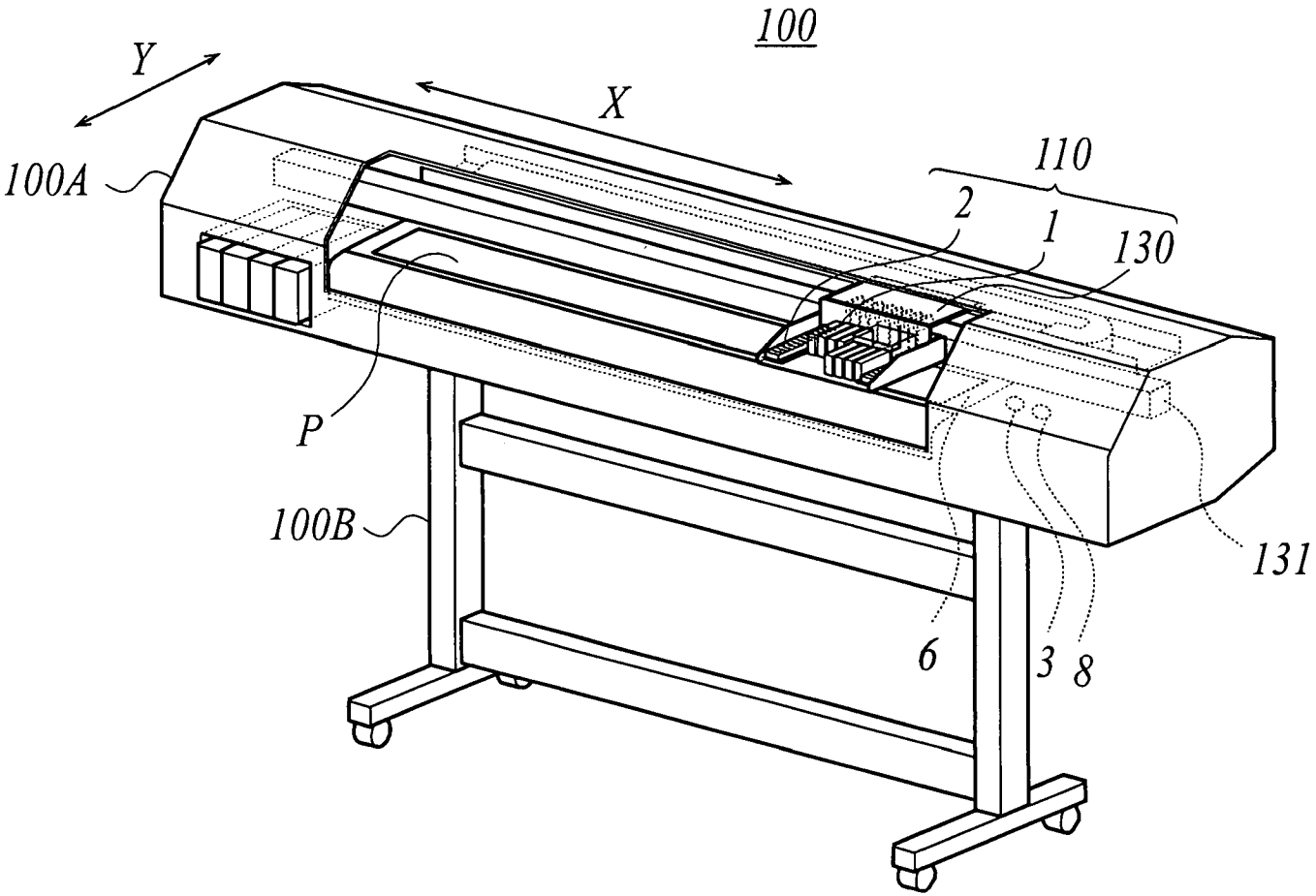
FIG. 1 is a perspective view showing a first embodiment of the present invention.

An embodiment to which the present invention is applied is an ink jet recording apparatus shown for example in FIG. 1.

As shown in FIG. 1, an ink jet recording apparatus 100 is provided with a printer body 100A and a support structure 100B for supporting the printer body 100A. The printer body 100A is constituted by comprising an image recording section 110 having a recording head 1 on which nozzles which are also ink jet openings are arranged, a light source apparatus 2 provided with an ultraviolet irradiating mechanism having a light source for irradiating ultraviolet rays, and a carriage 130 movably supported in the longitudinal direction of the body by a carriage rail 131 by mounting the recording head 1 and two light source apparatuses 2 so as to hold the recording head 1 and a platen 6 for providing a recording region, and a feeding mechanism (not shown) for feeding a recording medium by the platen 6.

In this case, the ink jet recording apparatus 100 records an image in accordance with a serial system for recording (printing) by jetting ink from the recording head 1 to a recoding medium P whose feeding in the direction (hereafter referred to as sub-scanning direction Y) orthogonal to the main scanning direction X which is a direction (that is, the above longitudinal direction) in which the recording head 1 moves by scanning a carriage 130 is stopped, while reciprocating the recording head 1 in the main scanning direction X, applying the ultraviolet rays irradiated from the light source apparatus 2, and thereby curing the ink.

The feeding mechanism is provided with a not-shown feeding motor, feeding roller and the like for example, so as to feed the recording medium P in the sub-scanning direction Y by rotating the feeding roller in accordance with the driving operation of the feeding motor. Moreover, the feeding mechanism intermittently feeds the recording medium P by repeating feeding and stopping of the recording medium P in accordance with the operation of the carriage 130 while recording an image.

Moreover, the ink jet recording apparatus 100 is provided with a light intensity sensor serving as a light intensity measuring section for measuring the light intensity of the light irradiated from the light source apparatus 2 and a temperature sensor 8 serving as a temperature measuring section for measuring the ambient temperature of the light intensity sensor 3 at the outside of the recording region so that the light intensity of the light source apparatus 2 is controlled in accordance with measurement results by the light intensity sensor 3 and temperature sensor 8.

Figure 2A:
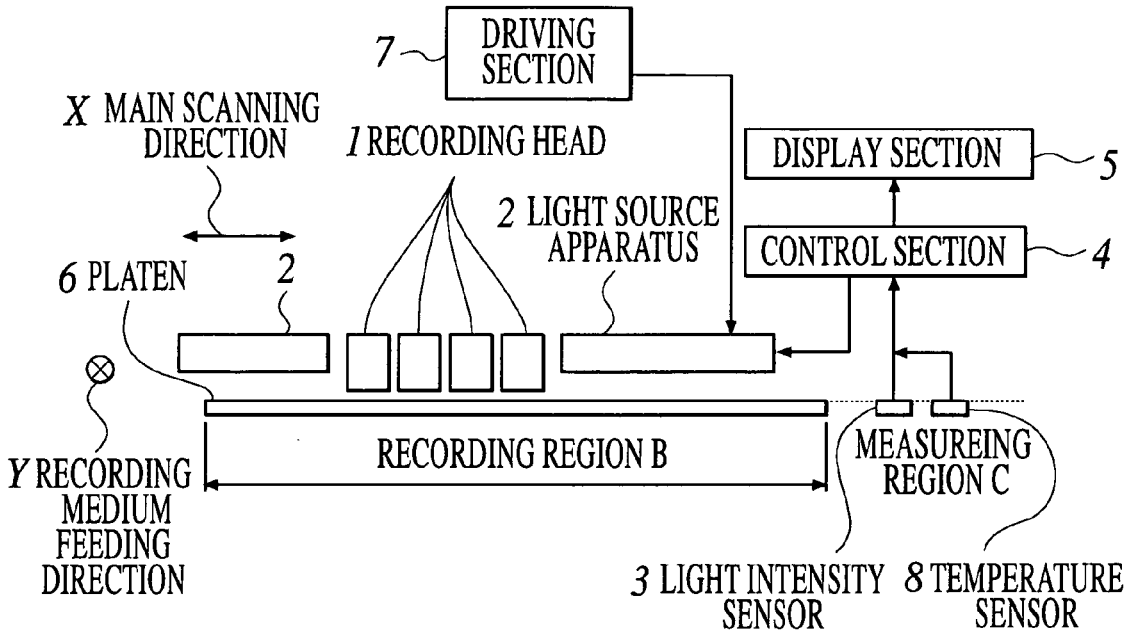
FIGS. 2A and 2B are illustrations schematically showing essential portions of the first embodiment.
Figure 2B:
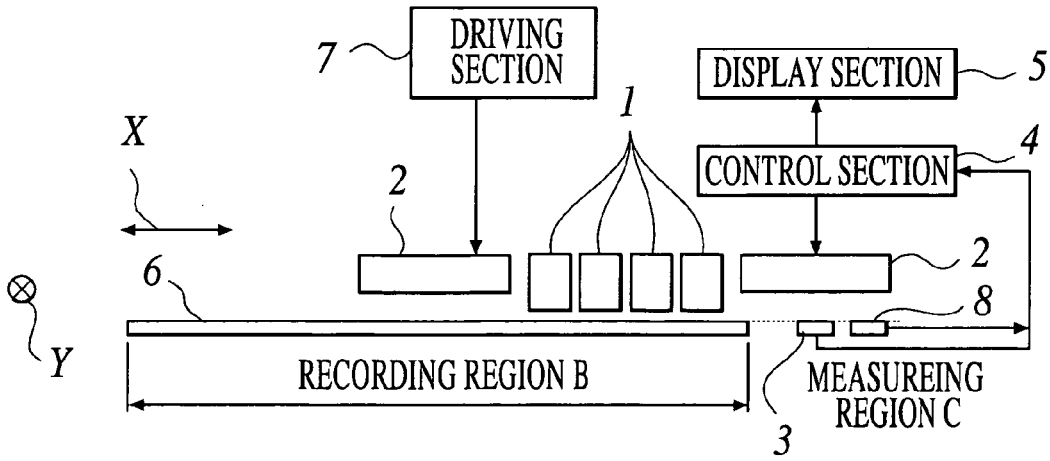

FIGS. 2A and 2B show essential portions of the ink jet recording apparatus 100. The ink jet recording apparatus 100 is provided with the platen 6 for forming a recording region B serving as a recording field of a recording medium, and the recording head 1 and light source apparatus 2 are arranged so as to face the platen 6. These are mounted on the carriage 130 as shown in FIG. 1 so that they are integrally scanned in the main scanning direction X which is the horizontal direction in FIGS. 2A and 2B in accordance with the driving operation of a driving section 7. Moreover, the light intensity sensor 3 and temperature sensor 8 are arranged nearby the platen 6 outside of the recording region B.

The recording head 1 has jet openings for jetting ink along the recording-medium feeding direction Y orthogonal to the main scanning direction X at the side opposite to a recording medium (not shown), so as to jet the ink on the recording medium in the recording region B.

In this case, it is possible to use as the ink an ultraviolet-curing cationic polymerization ink for example. Moreover, it is possible to use as the recording medium a medium having no ink absorbability for example.

The light source apparatus 2 is constituted by point light sources or tubular light source (not shown) so as to irradiate predetermined light such as ultraviolet rays to the jetted ink of a recording medium to cure the ink. Moreover, the light source apparatus 2 is moved in the main scanning direction X together with the recording head 1 in accordance with the driving operation of the driving section 7.

Furthermore, in FIGS. 2A and 2B, a pair of light source apparatuses 2 is set so as to hold the recording head 1 because the main scanning direction for recording an image is set to both right and left directions in FIGS. 2A and 2B. However, when the main scanning direction for recording an image is set to one direction, it is allowed to omit either of the light source apparatuses 2. That is, it is allowed to omit the right-side light source apparatus when the main scanning direction for recording an image is set to only right direction and omit the left-side light source when the main scanning direction is set to only left direction.

The platen 6 is a member for keeping the opposed distance between a recording medium and the recording head 1, that is, the ink flying distance constant, by keeping the feeding position of the recording medium at the predetermined position.

The light intensity sensor 3 is a light intensity measuring section which is set so as to face the light source apparatus 2 to measure the light intensity of the light irradiated from the light source apparatus 2. The light-intensity measurement result obtained from the light intensity sensor 3 is sent to the control section 4.

The temperature sensor 8 is a temperature measuring section set nearby the light intensity sensor 3 to measure the ambient temperature of the light intensity sensor 3. A temperature measurement result obtained from the temperature sensor 8 is sent to the control section 4.

The control section 4 is a light source control section for controlling the light intensity of the light source apparatus 2 in accordance with a light-intensity measurement result of the light intensity sensor 3 and a temperature measurement result of the temperature sensor 8. Moreover, the control section 4 has a not-shown temperature-light intensity conversion table which relates the ambient temperature of the light intensity sensor 3 with a corrected value considering the specific temperature characteristic under measurement of each light intensity sensor 3 and which will be consulted to correct the light intensity of the light source apparatus 2 in accordance with a temperature measurement result from the temperature sensor 8 so as to control the light intensity of the light source apparatus 2 in accordance with a corrected value obtained by consulting the table.

The control section 4 performs a predetermined determination in accordance with a light-intensity measurement result and a temperature measurement result and then, sends the control data on which a determination result is reflected to the light source apparatus 2 and display section 5.

It is allowed to use any unit as the display section 5 as long as the unit displays an image. For example, it is allowed to use a display terminal unit such as a liquid crystal display apparatus or CRT display apparatus. Moreover, it is allowed to constitute the display section 5 by adding a vocal apparatus for outputting voices according to necessity. The display section 5 displays respective measurement results of the light intensity sensor 3 and temperature sensor 8 and a light-source control state, a light source control state of the control section 4, and a content related to the predetermined error processing about light source control.

Functions of the first embodiment are described below.

Ink is jetted from the recording head 1 to a not-shown recording medium, ultraviolet rays are applied from the light source apparatus 2 to the ink, the ink is cured by the ultraviolet rays, and recording is performed.

When the above recording is performed, the light intensity sensor 3 measures the light intensity of the light irradiated from the light source of the light source apparatus 2 and the temperature sensor 8 measures the ambient temperature of the light intensity sensor 3. The control section 4 controls the light intensity of the light source apparatus 2 in accordance with these light-intensity measurement result and temperature measurement result.

Figure 3:
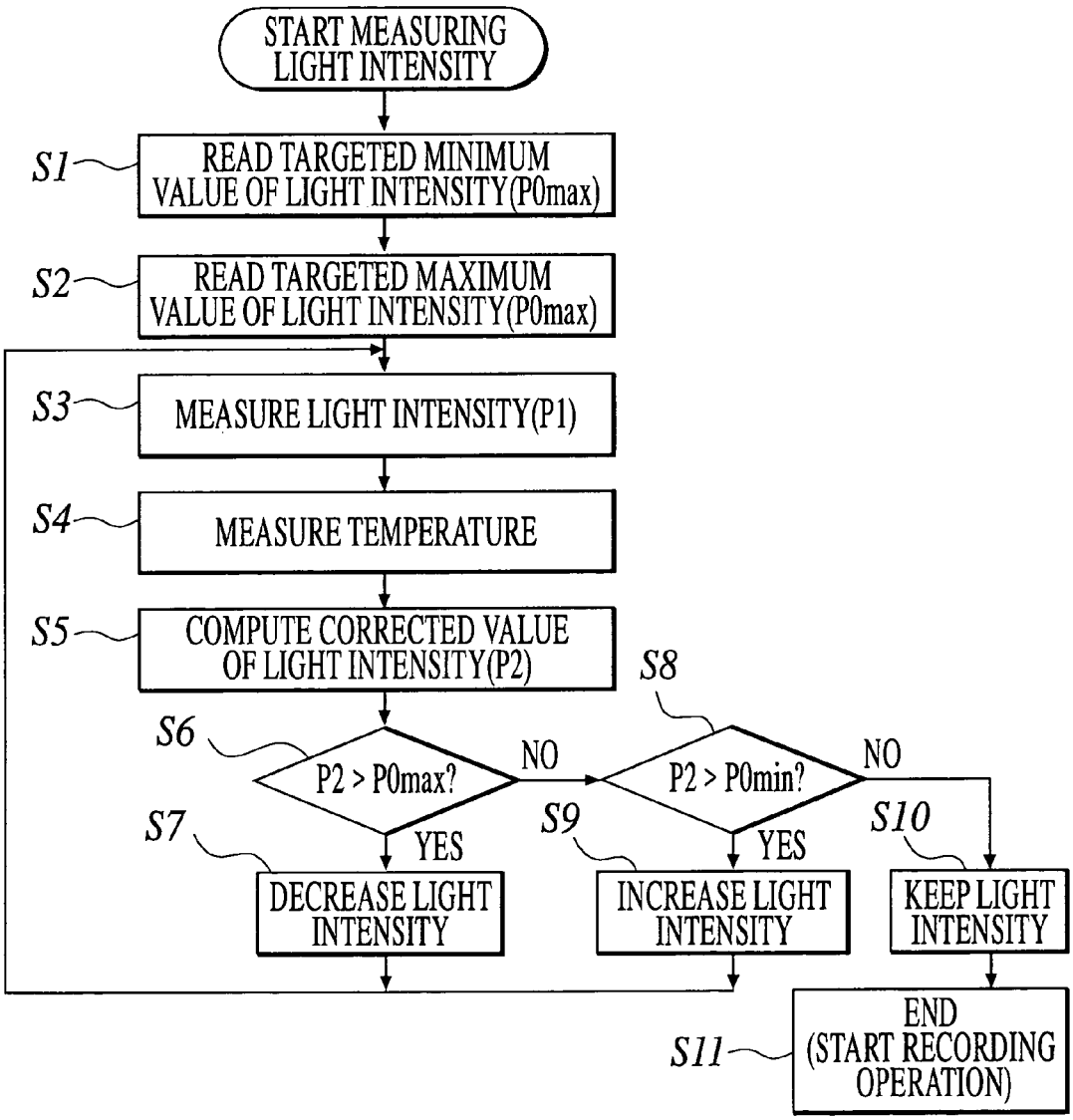
FIG. 3 is a flowchart for explaining the light intensity control performed by the first embodiment.

FIG. 3 is a flowchart showing an example of a series of operations for the lighting control. First, the control section 4 reads a targeted minimum value of light intensity $P0_{min}$ from predetermined storage means (step S1) and then reads a targeted maximum value of light intensity $P0_{max}$ in the same manner (step S2). It is allowed to previously read either value or simultaneously read both values. In this case, the targeted maximum value of light intensity $P0_{max}$ and targeted minimum value of light intensity $P0_{min}$ are calculated or experimentally obtained so that a cationic polymerization ink is cured but the ink is prevented from being cured at the nozzle face due to reflected light or the like, by considering various conditions such as the curing characteristic of the ink and the number of ink droplets dropped onto a recording medium.

Then, by the driving operation of the driving section 7, the light source apparatus 2 is moved to a measuring region C adjacent to the recording region B to measure a light intensity with the light intensity sensor 3 and obtain the measured value of light intensity P1 (step S3).

The temperature sensor 8 measures the ambient temperature of the light intensity sensor 3 (step S4) and the control section 4 obtains the corrected value of light intensity P2 from the temperature-light intensity conversion table in accordance with the above temperature measurement result and a corrected value (step S5).

Then, the control section 4 determines whether the obtained corrected value of light intensity P2 is larger than the targeted maximum value of light intensity $P0_{max}$ (step S6). When the determination result is YES, that is, it is determined that the corrected value of light intensity P2 exceeds the targeted maximum value of light intensity $P0_{max}$, the light intensity is lowered to decide a driving value for driving a light source so as not to exceed the targeted maximum value of light intensity $P0_{max}$ (step S7), then the light source apparatus 2 is controlled and light-intensity measurement (step S3), temperature measurement (step S4), and calculation for corrected value of light intensity (step S5) are performed to determine whether the obtained corrected value of light intensity P2 exceeds the targeted maximum value of light intensity $P0_{max}$ again (step S6).

In this case, it is allowed to perform a certain error processing instead of controlling the light source apparatus 2 so as to lower a light intensity, because the ink jetted to a recording medium may be cured at the nozzle face if it is determined that the light intensity exceeds the targeted maximum value of light intensity $P0_{max}$.

Moreover, when the determination result in Step 6 is NO, that is, it is determined that the light intensity does not exceed the targeted maximum value of light intensity $P0_{max}$, the control section 4 determines whether the corrected value of light intensity P2 does not exceed the targeted minimum value of light intensity $P0_{min}$ (sep S8).

When the determination result is YES, that is, when it is determined that the corrected value of light intensity P2 does not exceed the targeted minimum value of light intensity $P0_{min}$, the light intensity is lowered to decide a driving value for driving the light source so as to exceed the targeted minimum value of light intensity $P0_{min}$ (step S9), the light source apparatus 2 is controlled to perform light intensity measurement (step S3), temperature measurement (step S4), and calculation for corrected value of light intensity (step S5) and determine whether the obtained corrected value of light intensity P2 exceeds the targeted maximum value of light intensity $P0_{max}$ again (step S6).

However, when the determination result in step 8 is NO, that is, when it is determined that the corrected value of light intensity P2 exceeds the targeted minimum value of light intensity $P0_{min}$, a driving value for driving the light source is decided so as to keep the light intensity P2 (step S10) to control the light source apparatus 2. Moreover, the processing is completed, and the recording operation with use of the recording head 1 starts (step S11).

Moreover, as shown in step S9, it is allowed to perform a certain error processing instead of controlling the light source apparatus 2 so as to increase a light intensity, because the ink jetted to a recording medium is not cured when the light intensity does not exceed the targeted minimum value of light intensity $P0_{min}$.

The above error processing includes communication of the measurement result to a user by the display section 5. For example, a warning tone dedicated to insufficient light intensity is generated by a vocal apparatus and a measured value is displayed on an image display unit. It is preferable to display that a light intensity is insufficient. Thereby, it is possible to communicate the measurement result to a user.

Moreover, the error processing includes inhibition of a recording operation by the recording head 1. That is, start of the recording operation by the recording head 1 is inhibited or the recording operation is stopped if measurement is performed during the recording operation to execute communication to a user by the display section 5. Thereby, it is possible to inhibit the output of a printed matter in which uncured ink remains, it is prevented that a user obtains the printed matter without knowing the recording trouble, and the reliability of an ink jet recording apparatus is improved.

It is allowed to make the recording head 1 perform the recording operation only by communicating a measurement result to the user without inhibiting the recording operation by the recording head 1. Also in this case, the user can know that the ink jet recording apparatus operates at the less irradiance than ink-curing energy and a necessary action such as applying the light of another light source can be taken.

As described above, by use of the first embodiment, because each measuring instrument normally has a specific temperature characteristic and a slight fluctuation occurs in measurement results depending on an ambient temperature. Thereby, the fluctuation becomes a measurement error. Therefore, the control section 4 can more accurately control the light source corresponding to the ambient environment by considering the measurement result related to the temperature and controlling the light intensity of the light source apparatus 2.

Because the light intensity of the light source apparatus 2 can be accurately controlled, it is possible to improve the reliability of the ink jet recording apparatus and practically use the ink with high-curing sensitivity such as a cationic polymerization ink curable for a comparatively-low output light source.

Moreover, because the control section 4 controls the light intensity of the above light source in accordance with a value to be corrected which is obtained by consulting the temperature-light intensity conversion table, it is possible to previously form specific temperature characteristic of the light source measuring section into a conversion table and correct a measurement result by the light source measuring section in accordance with the temperature characteristics. Thereby, without a complex control such as a control of the light source apparatus sensitivity, the control operation of the control section 4 can be simplified by just obtaining a certain light intensity in accordance with measurement result from the light source apparatus and controlling the light source in accordance with the obtained light intensity.

Figure 4:
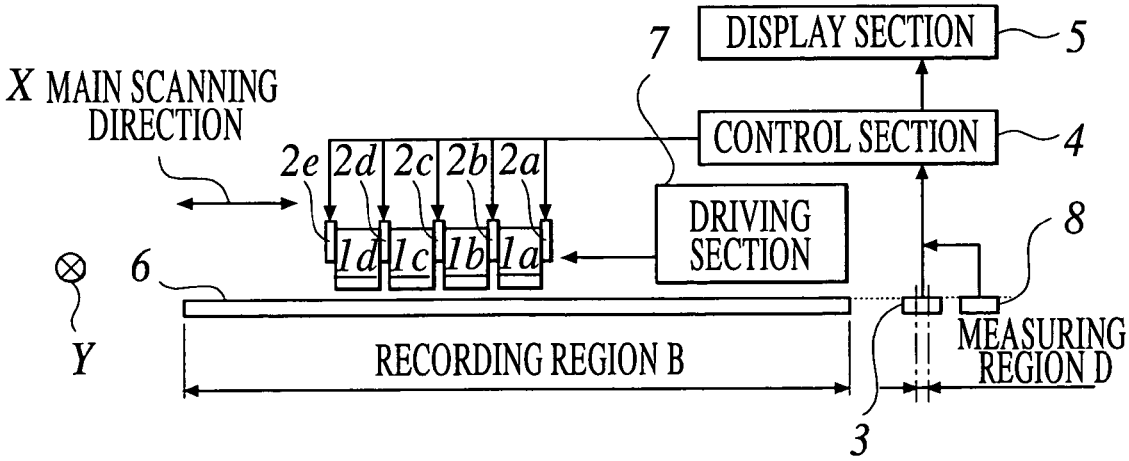
FIG. 4 is an illustration schematically showing an essential portion of a second embodiment of an ink jet recording apparatus of the present invention.

FIG. 4 shows an essential portion of a second embodiment of an ink jet recording apparatus of the present invention in which recording heads 1*a* to 1*d* and light source apparatuses 2*a* to 2*e* are mounted on a not-shown carriage such as the carriage 130 shown in FIG. 1 and integrally scanned in the main scanning direction X which is the horizontal direction in FIG. 4 in accordance with the driving operation of the driving section 7. On the carriage, the recording heads 1*a* to 1*d* are respectively set between the light source apparatuses 2*a* to 2*e* one by one.

Moreover, a light intensity sensor 3, control section 4, display section 5, platen 6, driving section 7, and temperature sensor 8 are the same as those shown in FIGS. 2A and 2B.

Functions of the second embodiment are described below.

When the carriage is moved in the left direction out of the main scanning directions X on FIGS. 2A or 2B by the driving section 7 under printing, recording (printing) is performed in a recording medium by irradiating ultraviolet rays from the light source apparatus 2*a* to the ink jetted onto the recording medium by the recording head 1*a*, irradiating ultraviolet rays from the light source apparatus 2*b* to the ink jetted onto the recording medium by the recording head 1*b*, irradiating ultraviolet rays from the light source apparatus 2*c* to the ink jetted onto the recording medium by the recording head 1*c*, and irradiating ultraviolet rays from the light source apparatus 2*d* to the ink jetted onto the recording medium by the recording head 1*d*.

However, when the carriage moves in the right direction out of the main scanning directions X in FIG. 2A or 2B, recording is performed in a recording medium by irradiating ultraviolet rays from the light source apparatus 2*b* to the ink jetted onto a recording medium by the recording head 1*a*, irradiating ultraviolet rays from the light source apparatus 2*c* to the ink jetted onto the recording medium by the recording head 1*b*, irradiating ultraviolet rays from the light source apparatus 2*d* to the ink jetted onto the recording medium by the recording head 1*c*, and irradiating ultraviolet rays from the light source apparatus 2*e* to the ink jetted onto the recording medium by the recording head 1*d*.

In the case of the above recording, when the light source apparatuses 2*a* to 2*e* face a measuring region D by the driving section 7 scanning a carriage, light intensities of the light source apparatuses 2*a* to 2*e* are respectively measured. Moreover, the ambient temperature of the light intensity sensor 3 is measured by the temperature sensor 8. The control section 4 controls the light intensity for each of light sources of the light source apparatuses 2*a* to 2*c* in accordance with these light intensity measurement result and temperature measurement result by use of the above-described temperature-light intensity conversion table, through the above described procedure for example.

For the second embodiment, a case of recording in the both right and left directions is described. However, it is allowed to operate the second embodiment as a recording apparatus for performing the recording operation only in the right or left direction. In this case, because either of the light source apparatuses 2*a* and 2*e* at the both ends becomes unnecessary, it is allowed to omit it.

Figure 5:
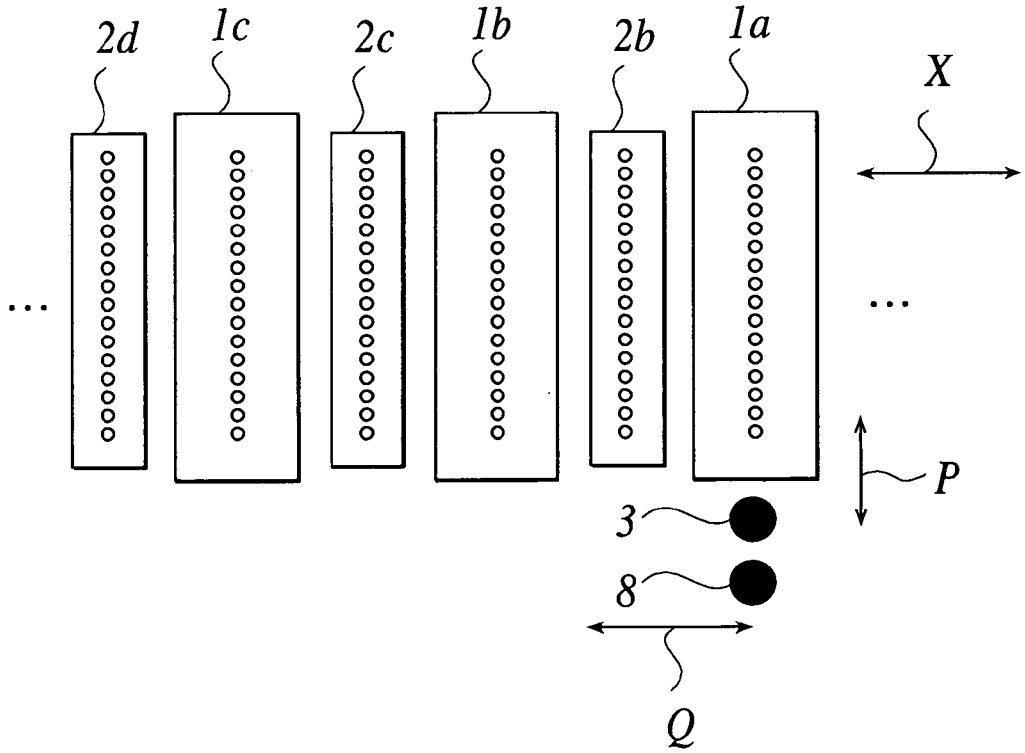
FIG. 5 is an illustration schematically showing the second embodiment.

Moreover, it is allowed to arrange the light intensity sensor 3 and temperature sensor 8 at the outside of the recording region B even if they are the inside of the platen 6 for the main scanning direction X as shown in FIG. 5 instead of arranging the sensors 3 and 8 at the outside of the platen 6 for the main scanning direction X and make a not-shown transfer section for moving the sensors 3 and 8 movably support them in the direction Q same as the main scanning direction X and the direction P vertical to the direction Q.

In the case of the above recording, the light intensity of each point light source is measured while the light intensity sensor 3 and temperature sensor 8 move the position opposite to each light source apparatus 2*b* in the direction P and the ambient temperature of the light intensity sensor 3 is also measured. When light intensity measurement of the light source apparatus 2*b* is completed, the light intensity sensor 3 and temperature sensor 8 move along the direction Q and the same light intensity measurement and temperature measurement are performed on the next light source apparatus 2*c*. Thus, light intensity measurement and temperature measurement are performed on all the light source apparatuses 2*a* to 2*e*. Moreover, it is allowed to restrict the moving direction of the transfer section to the direction P. In this case, it is allowed to move the carriage on which the recording heads 1*a* to 1*d* and the light source apparatuses 2*a* to 2*c* are mounted in the main scanning direction X or set the light intensity sensor 3 and temperature sensor 8 with respect to the light source apparatuses 2*a* to 2*e* respectively.

As described above, the second embodiment is effective to quickly irradiate ultraviolet rays to the ink attached on a recording medium in addition to the effect of the above-described first embodiment.

Moreover, though a driving section is originally necessary for each configuration in order to integrally drive recording heads and light source apparatuses by one driving section, it is possible to reduce duplicated configurations and thereby downsize a recording apparatus.

Figure 6:
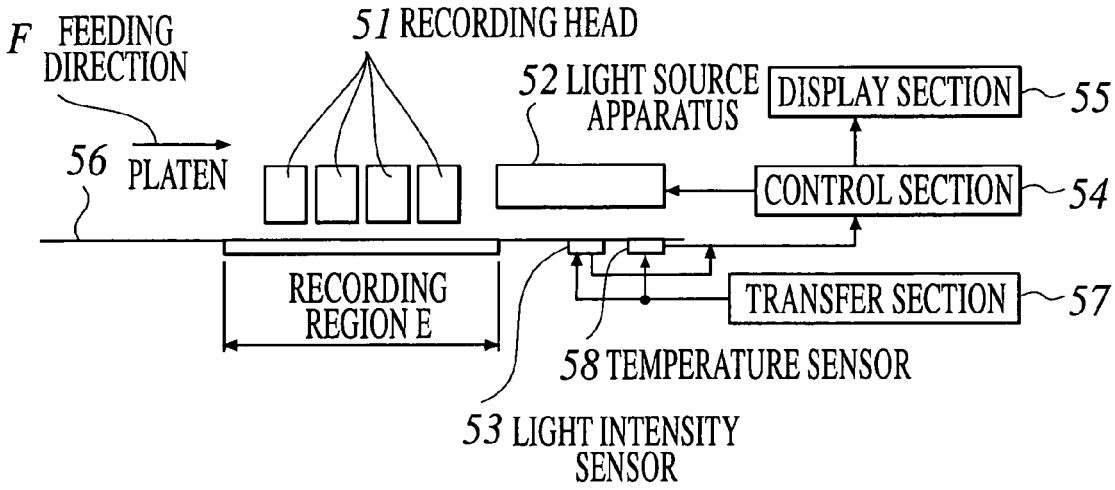
FIG. 6 is an illustration schematically showing an essential portion of a third embodiment of an ink jet recording apparatus of the present invention.

FIG. 6 shows an essential portion of a third embodiment of an ink jet recording apparatus of the present invention comprising a line type of recording head. The ink jet recording apparatus is provided with a platen 56 for forming a recording region E serving as a recording field of a recording medium. Moreover, a recording head 51 is set so as to face the platen 56 and a light source apparatus 52 is set to the downstream side of the recording head 51 in a recording-medium feeding direction F which is the right direction in FIG. 6. Moreover, a light intensity sensor 53 for measuring the light intensity of the light source apparatus 52 and a temperature sensor 58 for measuring the ambient temperature of the light intensity sensor 53 are set nearby the platen 56 outside the recording region E.

Furthermore, the ink jet recording apparatus is provided with a transfer section 57 for moving the light intensity sensor 53 and temperature sensor 58 up to the measuring position opposite to the light source apparatus 52.

In this case, it is possible to use an ultraviolet-curing cationic polymerization ink. Moreover, it is possible to use a recording medium having no ink absorbability.

Figure 7:
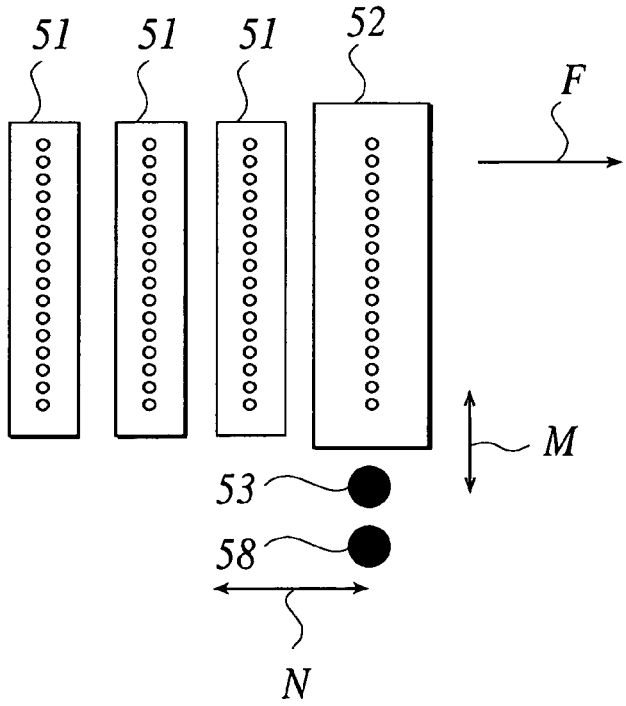
FIG. 7 is an explanatory drawing for explaining the operation of the light intensity sensor and the temperature sensor of the third embodiment.

As shown in FIG. 7, the light source apparatus 52 is constituted by point light sources or tubular light source, which irradiates a predetermined light such as ultraviolet rays to the ink jetted onto a recording medium and cures the ink.

The platen 56 is a member for keeping the distance between a recording medium and the recording head 51, that is, the ink flying distance constant by keeping the feeding position of the recording medium at a predetermined position.

The light intensity sensor 53 is a light intensity measuring section set to a position outside the platen 56 on the feeding direction F to measure the light intensity of the light irradiated from the light source apparatus 52. A light intensity measurement result obtained from the light intensity sensor 53 is sent to a control section 54.

The temperature sensor 58 is a temperature measuring section set nearby the light intensity sensor 53 to measure the ambient temperature of the light intensity sensor 53. A temperature measurement result obtained from the temperature sensor 58 is sent to the control section 54.

It is allowed to set standby positions of the light intensity sensor 53 and temperature sensor 58 to positions outside the recording region E even if they are inside a platen 56 on the feeding direction F as shown in FIG. 7 instead of setting the positions to the outside the platen 56 on the feeding direction F as shown in FIG. 6.

The light intensity sensor 53 and temperature sensor 58 can be moved in the direction N same as the feeding direction F and bi-directional, and in the direction M vertical to the direction N, by a transfer section 57 for movably supporting them. Besides, each light source apparatus 52 may be set to the downstream side of the feeding direction F of each recording head 51.

The control section 54 is the same as the control section 7 shown in FIG. 2, which is a light source control section for controlling the light intensity thereof by the lighting control of the light source apparatus 52 in accordance with a light intensity measurement result of the light intensity sensor 53 and a temperature measurement result of the temperature sensor 58 and having a temperature-light intensity conversion table for such control.

The control section 54 sends the control data to which a predetermined determination is applied to reflect the determination result to the light source apparatus 52 and a display section 55.

It is allowed to use any one as the display section 55 the same as the case of the display section 5 shown in FIG. 2 as long as it displays an image. For example, a display terminal unit such as liquid crystal display apparatus or CRT display apparatus can be used.

Functions of the third embodiment are described below.

Ink is jetted onto a recording medium fed through the platen 56 by the recording head 51, the portion of the recording medium to which the ink is jetted is fed up to a light irradiation region where ultraviolet rays are irradiated from the light source apparatus 52 toward the ink, the ink is cured by the ultraviolet rays, and printing (recording) is performed.

In the case of the above recording, the light intensity sensor 53 measures the light intensity of the light irradiated from the light source of the light source apparatus 52 and the temperature sensor 58 measures the ambient temperature of the light intensity sensor 53. The control section 54 performs the lighting control of the light source of the light source apparatus 52 in accordance with, for example, the above-described procedure in accordance with these light intensity measurement result and temperature measurement result.

As described above, by use of the third embodiment, it is possible to obtain the same advantage as the advantage obtained from the above-described serial type of recording head even when a line type of recording head is used.

It is possible to form a measuring region in a recording region in the case of the above first to third embodiments. In such a case, light intensity is measured when a recording medium does not enter between a light source and a light intensity sensor. That is, it is possible to measure the light intensity of a light source by a light intensity sensor in the period from the time when the rear end of a recording medium passes between the light source and the light intensity sensor until the time when the front end of the next recording medium enters between the light source and the light intensity sensor. In this case, it is necessary to constitute the platen 6 by a material allowing the light with a predetermined wavelength to pass therethrough. Such light can cure ink. For example, the platen 6 is constituted by, for example, a transparent member such as transparent glass or resin.

In the first to third embodiments, it is possible to measure the light intensity of a light source every one-time scanning for image formation as the minimum unit of a time interval for measuring the light intensity of a light source. By frequently performing light intensity measurement such as performing light intensity measurement every one-time scanning for image formation, it is possible to immediately detect a comparatively short period change such as lowering of a dose due to ink mist.

When a printing speed may be lowered or when a comparatively long term light-intensity change (for example, lowering of light source output due to deterioration of electric system including light intensity sensor) is exclusively regarded as a problem, light intensity is measured by using the period of starting the apparatus or the period when waiting for a sheet interval or an indicative input of printing work. Moreover, it is allowed to measure light intensity by premising the elapse of a preset time.

The embodiments of the present invention are described above. However, the present invention is not restricted to these embodiments. It is needless to say that the present invention can be properly modified so as not to deviate from the scope of the present invention.

The entire disclosure of Japanese Patent Applications No. Tokugan 2003-137846 filed on May 15, 2003 including specification, claims, drawings and summary are incorporated herein by reference in its entirety.

What is claimed is:

1. An ink jet recording apparatus comprising:

an ink jet type of a recording head in which ink jet openings for jetting a photo curing ink are arranged so as to face a recording medium;

a light source which is set so as to be opposite to a face of the recording medium to which ink is jetted, and which irradiates a light for curing the ink after the ink is jetted;

a light intensity measuring section for measuring a light intensity of the light irradiated from the light source;

a temperature measuring section for measuring an ambient temperature of the light intensity measuring section; and a light source control section for correcting a measured light intensity of the light source in accordance with measurement results from the light intensity measuring section and the temperature measuring section.

2. The ink jet recording apparatus of claim 1, wherein a temperature-light intensity conversion table consulted to correct the light intensity in accordance with a temperature measurement result from the temperature measuring section is provided, the light source control section controls the light intensity of the light source in accordance with an intensity to be corrected, and the intensity is obtained by consulting the temperature-light intensity conversion table.

3. The ink jet recording apparatus of claim 1, wherein a driving section for scanning the light source up to a measuring position opposite to the light intensity measuring section is provided.

4. The ink jet recording apparatus of claim 1, wherein a transfer section for scanning the light intensity measuring section up to the measuring position opposite to the light source is provided.

5. The ink jet recording apparatus of claim 1, wherein light source apparatuses having the light source are provided, and the light intensity measuring section measures the light intensity of each light source apparatus.

6. The ink jet recording apparatus of claim 1, wherein the ink jetted from the recording head is an ultraviolet curing ink.

7. The ink jet recording apparatus of claim 1, wherein the ink is a cationic polymerization ink.

* * * * *